United States Patent [19]

Ward et al.

[11] 4,040,562

[45] Aug. 9, 1977

[54] PLASTIC BAG AND CARRIER HANDLE

[75] Inventors: Gregory A. Ward, Balboa Island; Lawrence P. Casey, III, Garden Grove, both of Calif.

[73] Assignee: Casard Industries, Inc., Newport Beach, Calif.

[21] Appl. No.: 339,504

[22] Filed: Mar. 9, 1973

[51] Int. Cl.[2] ..... B65D 33/06

[52] U.S. Cl. ..... 229/54 R; 150/12; 223/91; 229/62

[58] Field of Search ..... 229/62, 54 R; 150/5, 150/6, 7, 8, 12; 224/45 H; 24/200, 30.5 R; 223/87, 88, 91, 95, 96; D8/154; D9/192

[56] References Cited

U.S. PATENT DOCUMENTS

| | | | |
|---|---|---|---|
| 1,079,527 | 11/1913 | Wallace | 229/62 |
| 1,246,530 | 11/1917 | Bird | 229/62 X |
| 3,266,711 | 8/1966 | Song | 229/62 |
| 3,383,017 | 5/1968 | Krings | 150/12 X |
| 3,673,640 | 7/1972 | Brown | 24/30.5 R |
| 3,760,940 | 9/1973 | Bustin | 229/53 |
| 3,790,045 | 2/1974 | Rigel et al. | 223/87 |
| D. 148,407 | 1/1948 | Cleary | 223/88 X |

FOREIGN PATENT DOCUMENTS

| | | | |
|---|---|---|---|
| 8,027 | 11/1932 | Australia | 24/30.5 |
| 96,974 | 9/1963 | Denmark | 206/806 |

*Primary Examiner*—Stephen P. Garbe
*Attorney, Agent, or Firm*—Knobbe, Martens, Olson, Hubbard & Bear

[57] ABSTRACT

A plastic bag of flat, frusto-conical form has an open upper end formed to receive a filling nozzle and to serve as a funnel when the bag is being emptied, and a carrier handle has three arms for receiving the upper end of the bag with the bag forming a loop which extends about a first handle arm and is frictionally locked on a second arm, a third arm preventing leakage or back surge from the bag, and the narrower open end of the mouth of the bag being fully sealed by a wider lower portion of the bag mouth.

4 Claims, 6 Drawing Figures

FIG. 3.
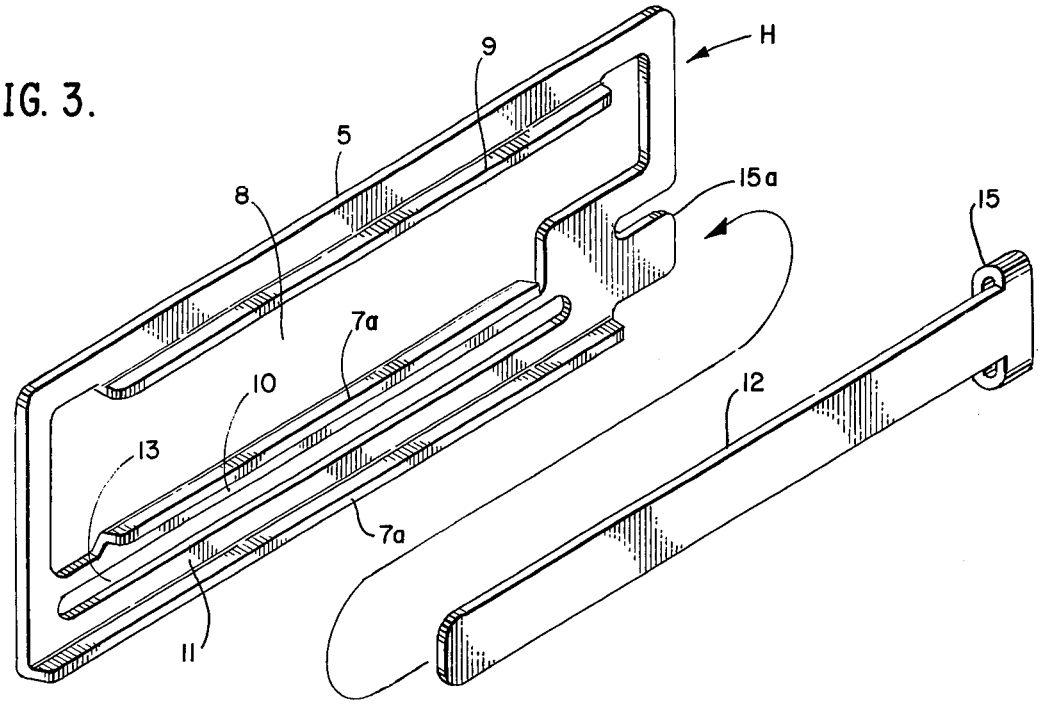
FIG. 4.
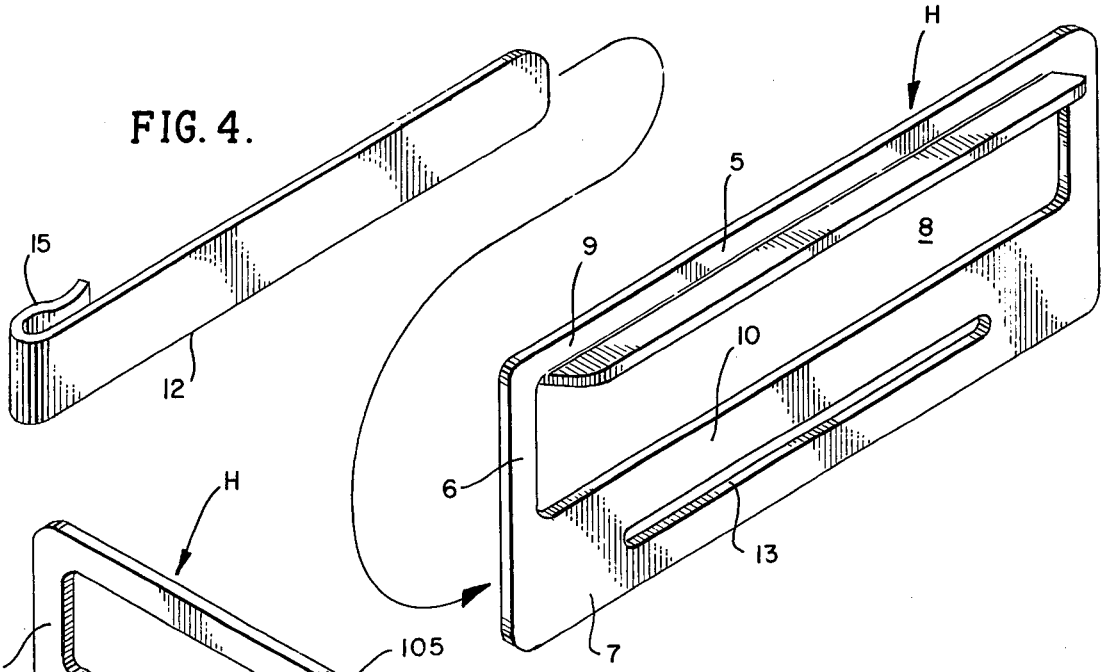
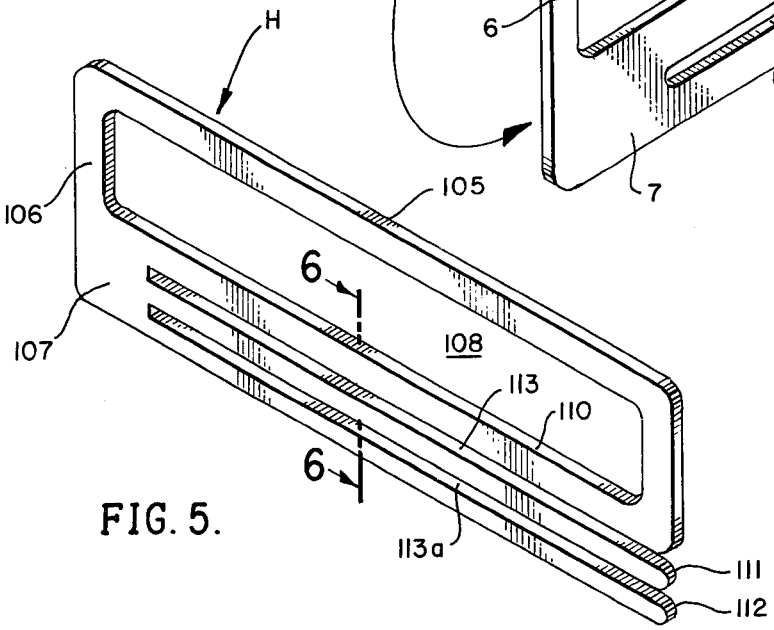
FIG. 5.

PLASTIC BAG AND CARRIER HANDLE

BACKGROUND OF THE INVENTION

Receptacles which are to be used on infrequent occasions, such as, for example, gasoline cans for emergency used by gasoline filling stations, are expensive and occupy considerable space. In addition, such cans are frequently leaky and in poor condition or rusty if they are ever used for water. Because of the cost of such cans, gasoline filling stations generally require security deposit when a customer takes the can away, and the customer may be inconvenienced further by the need to return the can.

The carrying of gasoline or other highly volatile or flammable liquids in glass bottles is hazardous and in many areas forbidden, due to the likelihood of breakage.

SUMMARY OF THE INVENTION

The present invention provides a novel, simple, inexpensive, yet effective, receptacle or bag and carrier handle which can be stored in a small space and conveniently employed to safely transport liquid.

More particularly, the invention involves a plastic bag, say of polyethylene, which can be manufactured at low unit cost and which is therefore, disposable after use, and a carrier handle constructed to cooperate with the upper end of the bag in such a manner that the bag is self-locking with the handle and sealed against leakage.

The bag and handle may be utilized to carry a variety of liquid, powdered or other substances, and, for example, the bag and handle are ideally suited for use as an emergency gasoline carrier capable of holding a small emergency quantity of gasoline, say one gallon. When used as gasoline carrier, the bag is capable of storage, at filling stations, a roll to enable to large number of bags to be stored conveniently without occupying much space, or a number of the bags and a companion handle may be conveniently carried in an automobile or other gas powered vehicle.

Other uses of the combined bag and handle are apparent, such as at grocery stores for carrying loose goods stored in bulk, but in any event the handle may be used with bags for a wide variety of materials, and the handle is inexpensive, simple, and constructed to make the attachment to the bag simple and self-sealing.

The bag is so formed as to hold a quantity of material, such as a liquid, in such a manner that the load of the material is imposed on a relatively small surface area of the handle to effect a tight seal and frictional interlocking of the bag on the handle. More particularly, the bag is of tapered or frusto-conical form to provide a mouth portion which is relatively narrow and depending portion which diverges uniformally downwardly. The handle has first and second arm portions providing an arm over which a loop in the mouth portion is extended, the loop extending about the second arm portion, so that the weight of the material in the bag effectively clamps the mouth end of the bag against the first arm. A third arm adjacent to the second arm prevents surges of material from passing through the mouth portion.

The frusto-conical form of the bag facilitates filling of the bag, and is tightly sealing by a larger, lower portion of the bag mouth which presses against the narrower open end and forces it closed; and the bag constitutes a funnel which facilitates pouring material from the bag. For example, the mouth of the bag may be relatively small, but capable of receiving the discharge end of a nozzle of a gasoline pump at a filling station. When the contents of the bag are to be poured from the bag, the narrow mouth portion can be inserted into the fill opening of an automobile and the gasoline in the bag will expand the mouth portion of the bag into a tight fit with the fill opening. The bag is also provided with a corner tab having a hole for hanging storage and for facilitating emptying of the bag.

The handle may take a number of forms to provide the three arms and a grip portion in a unit or assemblage which can be inexpensively stamped from metal or molded in plastic. In certain of the forms two of the arms may be integral with the grip and the third arm may be in the form of a bar adapted to be inserted into the loop of the bag mouth portion extending through a space between the two integral arms. The bar may be of a simple form including clamp or holding means for securing the bar to the body or the handle against rotation under the weight of the loaded bag. In another form the three arms may be all integral with the grip portion and the looped bag mouth portion can then be slideably engaged between the arms.

This invention possesses many other advantages, and has other purposes which may be made more clearly apparent from a consideration of the forms in which it may be embodied. These forms are shown in the drawings accompanying and forming part of the present specification. They will now be described in detail, for the purpose of illustrating the general principals of the invention; but it is to be understood that such detailed descriptions are not to be taken in a limiting sense.

BRIEF DESCRIPTION OF THE DRAWINGS

FIG. 3 is an exploded detail, showing the handle of FIG. 1 and the bar in perspective;

FIG. 4 is a view of corresponding to FIG. 3, but showing a modified bar, with a retainer clamp;

FIG. 5 is a view in perspective of a handle wherein all three bars are integral with the grip.

DESCRIPTION OF THE PREFERRED EMBODIMENTS

Figure 1:
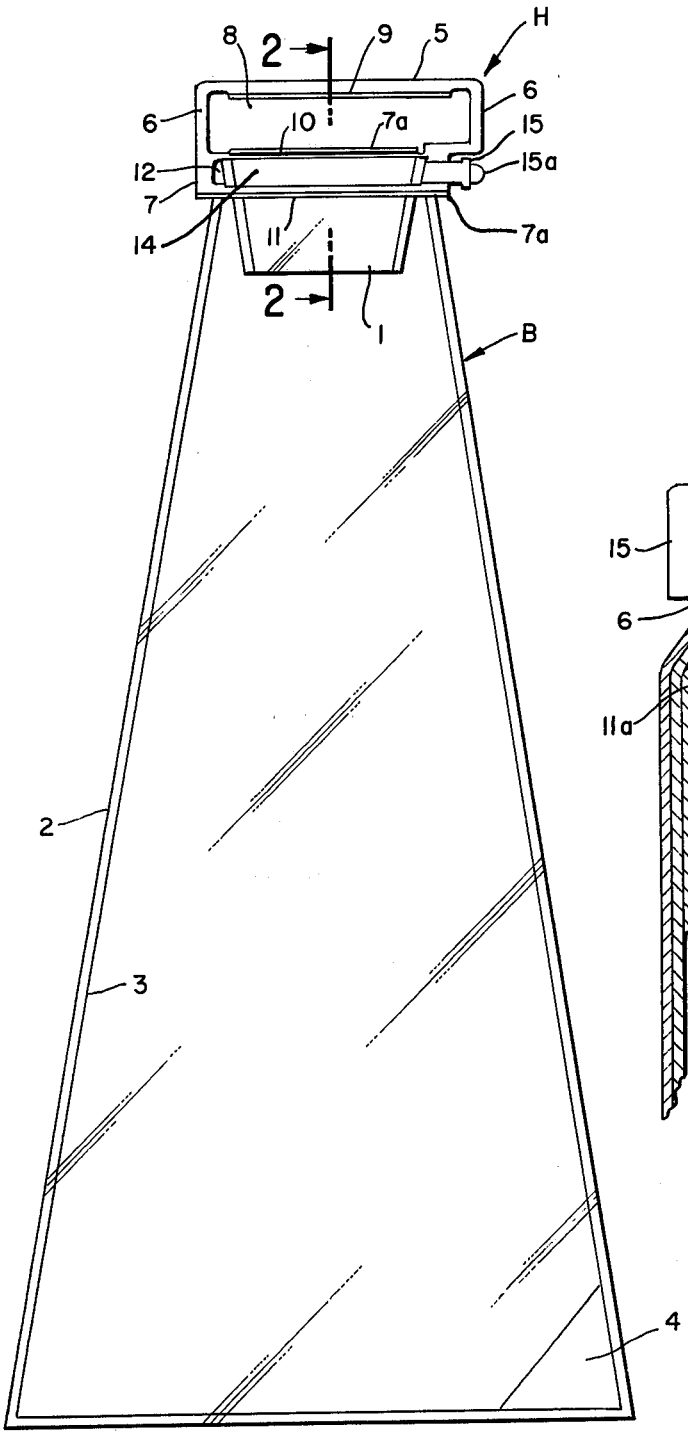
FIG. 1 is an elevation of a bag and handle according to the invention.

Referring to FIG. 1, a bag B is shown in combination with a handle H. The bag B has a mouth portion 1 engaged with the handle and a main portion or body 2 depending from the handle and adapted to contain a desired quantity of material, such as, a gallon of gasoline, a quantity of powdered or other particulate material, or the like.

In its preferred form, the bag is formed as a frustum of a long cone, shaped so that the load of the material is progressively applied through the side walls of the bag to the mouth portion which is interlocked with the handle, as will be later described, responsive to the load. The frusto-conical shape of the bag also provides a receptacle which minimizes voids and sloshing tendency. For an example, a bag adapted to contain one gallon of gasoline, has an opening at the mouth of 3 inches, a length of 24 inches and a base of 11 inches, and such a bag can be easily carried by an average person without dragging on the ground. Such a bag made of two layers of polyethylene may be bonded by heat and pressure at a marginal seam 3 and may be produced in a roll or in multiple bag units adapted to be stored in flat or folded condition, and the bags being adapted to be separated when used. At a lower corner, the bag has an eye 4 for enabling ease of manipulation when the contents are being emptied or for enabling the bags to be stored on a hook or the like before use. The frusto-conical mouth portion assures proper pressure sealing contact across the entire width of the mouth by the wider lower portion of the bag which presses the mouth functionally into locking engagement with the handle.

The handle H comprises a grip portion 5 extending between integral end members 6 which connect the grip portion 5 to a bag engaging portion 7 of the handle, a finger space 8 being provided beneath the grip portion. When the handle is thin in cross section, the grip portion 5 is preferably provided with a laterally extend flange 9 which provides increased gripping surface and renders the handle more comfortable to a carrier. In addition, outstanding ribs or flanges *7a* provided to render the bag holding portion more rigid.

Figure 2:
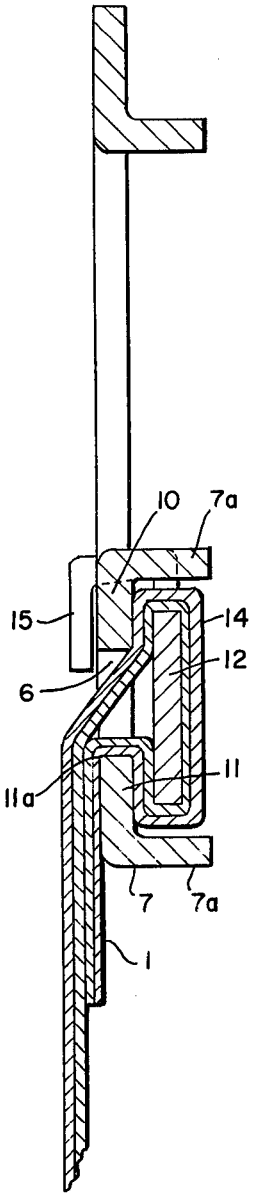
FIG. 2 is a fragmentary vertical section, as taken on the line 2—2 of FIG. 1, and on an enlarged scale.

The bag engaging portion 7 of the handle comprises three elongated and parallel arms 10, 11 and 12, disposed in vertically spaced relation. In the form of FIGS. 1–3, the arms 10 and 11 are integrated with the end portions 7 and vertically spaced to form a slot 13 therebetween the ribs *7a* adapted to receive a looped or doubled over portion 14 of the mouth portion 1 of the bag B. The third arm 12 is in the form of a separate bar adapted to be inserted endwise through the looped bag portion 14 and, by the weight of material in the bag, forced into abutting contact with the handle ends 6 between the ribs *7a.* Bar retainer means 15 are provided on the handle or on the bar 12, shown as ears on the bar and a companion lug 15*a* on the handle and adapted to be engaged by the ears 15, to maintain the bar 12 and the opposed surfaces of the arms 10 and 11, as seen in FIG. 2, wherein it will be noted that the bar 12 has a vertical space greater than the slot 13.

As also seen in FIG. 2, the mouth end 1 of the bag is pressed against an upper edge 11*a* of the arm 11, depending upon the weight of the material in the bag, so that the bag is sealed entirely across its mouth and functionally interlocked with the handle, since the wider portion of the bag contacts the narrower mouth portion to maintain the interlocked and sealed engagement. In this form, the weight of the material in the bag also maintains a clamping action on the bag between the arm 12 and the opposing arms 10 and 11 to further seal functionally grip the bag.

In FIG. 4 the handle H has a grip portion 5 and bag engaging portion 7 corresponding to the first described embodiment, but the bar 12 has a clamp means 15 at one end adapted to frictionally grip the body of the handle when the arm 12 of this form is inserted through the looped portion of the bag extending through the slot 13.

Figure 6:
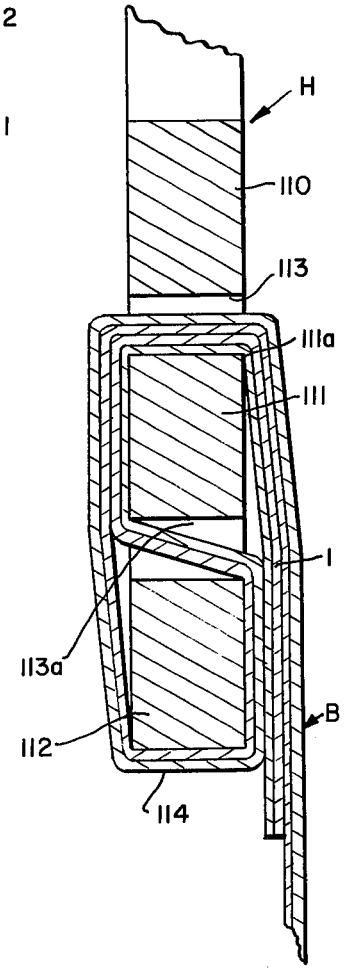
FIG. 6 is a fragmentary vertical section, as taken on the line 6—6 of FIG. 5, on an enlarged scale and shwoing the mouth portion of the bag in place.

In the embodiment of FIGS. 5 and 6, the handle H has a somewhat modified form. Here, the grip portion 105, ends 106 and arm 110 cooperate to form the finger opening 108 above the bag engaging portion 107 with which not only the arm 111 is integral, but also the arm 112, and the slot 113 is open at one end, between the arms 110 and 112. The space 113a between the arms 110 and 112 is also open at the end. In this form, the looped portion 114 of the bag is applied endwise over the free end of the arm 112 and the doubled mouth portion 1 of the bag is slid between the arms 110 and 111 in the slot 113.

Thus, in this form the weight of the material in the bag presses the narrow mouth portion 1 into interlocked positional engagement with the edge 111*a* of the arm 112 and into engagement with the lateral faces of the arm 111.

From the foregoing, it will not be apparent that the invention provides a novel, simple and inexpensive handle for cooperation with the bag of novel form which is adapted to carry the load effectively and to seal the mouth end of the bag entirely across the open mouth by pressure engagement of a wider portion of the bag mouth against a surface of the handle. When the bag has been filled with liquid, the bag may be laid down horizontally, and the liquid in the bag will maintain sealing engagement of the mouth end of the bag against the handle.

We claim:

1. A container for the manual emergency transportation of a small quantity of fuel by a vehicle operator, comprising:

a pair of thin, flexible sheet members having a substantially trapezoidal surface configuration, said sheet members overlying one another, the edges of said sheets bonded together by a marginal seal which extends throughout substantially the entire length of the respective sides and base of said trapezoidal sheets but not the top thereof, the upper portion of said bonded pair of sheet members, removed from said base seam, forming a cone, truncated at said top, when said container is filled with fuel and inverted, the open truncated top of said cone being large enough to receive the standard nozzle used at filling stations for supplying fuel to said bag, the weight of fuel included in said container during use being progressively applied through said trapezoidal sheet members to said top when said container is carried, said top of said trapezoidal sheets sized to permit said top, when placed in the fill opening of an automobile when said container is inverted, to expand against said opening to form a tight fit with said opening to prohibit fuel leakage and thereby operate as a sealed funnel for the included fuel during discharge from the container; and a handle including a grip portion adapted to be hand held by said operator and a sealing portion, said sealing portion including a gripping surface for frictionally engaging said flexible sheet members adjacent the top of said trapezoidal surfaces;

said top of said trapezoidal sheets wrapped around said sealing portion of said handle to press said pair of sheets adjacent said top against one another in sealing engagement between said gripping portion of said handle and a portion of said sheets removed from said top, so that the weight of said included fuel seals said top of said sheets together when said container is manually carried.

2. A container as defined in claim 1 wherein said top of said trapezoidal sheets have a length of 3 inches.

3. A container as defined in claim 1 wherein said sheets are formed of polyethylene.

4. A container for the manual emergency transportation of a small quantity of fuel by a vehicle operator, comprising:

a flat, container tapered between a small upper end and a larger lower end having a pair of flat, tapered, flexible wall members marginally connected at the lower end and sides but open at the upper end, a portion of said wall members adjacent said upper end forming a tapered mouth which expands to a conical configuration, truncated at said upper end, when said mouth is filled with fuel, said mouth, when expanded, sized to fit tightly within the fuel fill opening of a vehicle; and a handle for manually carrying said container, said handle having a gripping member about which said mouth is wrapped, the weight of fuel in said container pressing said mouth closed around said handle.

* * * * *

UNITED STATES PATENT AND TRADEMARK OFFICE

CERTIFICATE OF CORRECTION

PATENT NO. : 4,040,562

DATED : August 9, 1977

INVENTOR(S) : Gregory A. Ward and Lawrence P. Casey, III

It is certified that error appears in the above-identified patent and that said Letters Patent are hereby corrected as shown below:

Column 1, line 7, change "used" to --use--; line 54, after "and", before "depending", insert --a--.

Column 2, line 41, delete "of"; line 46, change "shwo" to --show--.

Column 3, line 19, change "extend" to --extended--; line 22, after "7a", before "provided", insert --are--; line 51, after "seal", before "func-", insert --and--.

Column 4, line 8, change "not" to --now--.

Signed and Sealed this

First Day of November 1977

[SEAL]

*Attest:*

RUTH C. MASON
*Attesting Officer*

LUTRELLE F. PARKER
*Acting Commissioner of Patents and Trademarks*